US006883262B1

(12) United States Patent
Von Muller

(10) Patent No.: US 6,883,262 B1
(45) Date of Patent: Apr. 26, 2005

(54) LOCKING DEVICE FOR LEVER ACTION FIREARMS

(76) Inventor: Francis Von Muller, 153 State St., Brooklyn, NY (US) 11201

( * ) Notice: Subject to any disclaimer, the term of this patent is extended or adjusted under 35 U.S.C. 154(b) by 170 days.

(21) Appl. No.: 10/407,767

(22) Filed: Apr. 3, 2003

(51) Int. Cl.[7] ..... F41A 17/00
(52) U.S. Cl. ..... 42/70.11; 42/70.01; 42/70.07
(58) Field of Search ..... 42/70.11, 70.01, 42/70.07

(56) References Cited

U.S. PATENT DOCUMENTS

| | | | | | |
|---|---|---|---|---|---|
| 2,882,636 | A | * | 4/1959 | Shinaver | 42/70.06 |
| 3,673,725 | A | | 7/1972 | Cravener | 42/1 R |
| 3,774,333 | A | | 11/1973 | Reynolds | 42/1 R |
| 4,024,664 | A | * | 5/1977 | Murabito | 42/70.08 |
| 4,122,620 | A | | 10/1978 | Alexander | 41/12 P |
| 4,624,372 | A | | 11/1986 | Brolin | 211/4 |
| 5,125,178 | A | | 6/1992 | Justice | 42/70.11 |
| 6,568,117 | B1 | * | 5/2003 | Weinraub | 42/70.11 |
| 2002/0116856 | A1 | | 8/2002 | Troyer | |

* cited by examiner

*Primary Examiner*—Jack Keith
*Assistant Examiner*—M. Thomson
(74) *Attorney, Agent, or Firm*—Robert W. J. Usher

(57) ABSTRACT

A locking device clamps an abutment on the lever of a lever action firearm to engage the small of the stock preventing the lever being closed into depressing engagement with a pin on the stock which, if depressed, would disengage an internal safety device disconnecting/blocking the trigger and permit discharge of the firearm. The lever has a handle loop providing opposed, spaced apart rails and the clamp has plate-like clamping jaws with rail-seating grooves locating the jaws on the rails in bridging relation with the abutment extending towards the stock integrally formed by ends of the plates. A key or combination lock engages in a snap action by moving the plates together and biasing springs throw the plates apart when unlocked.

11 Claims, 2 Drawing Sheets

LOCKING DEVICE FOR LEVER ACTION FIREARMS

FIELD OF THE INVENTION

The invention relates to a locking device for lever action firearms.

BACKGROUND OF THE INVENTION

In these present times of increasing concern for firearm safety, considerable attention has been directed at devising safety locks for firearms that restrict use of the firearms to their owners only. In addition, various localities have instituted ordinances requiring safe home storage and transport of firearms.

A majority of gun lock design efforts to answer these needs have been confined to producing gun locks for use with firearms having fixed trigger guards that were not adaptable to firearms having movable trigger guards such as those of lever action type guns where the trigger guards are part of the actuating levers which typically rotate downward during the reloading cycle of the firearms.

As this type of firearm comprises a large proportion of weapons in use by hunters today, this present invention is directed at meeting this need with a unit which is of relatively simple and economic construction and is convenient to install and remove in the field to encourage frequent use.

There is at least one example of a prior attempt at resolving the problem documented in U.S. Patent Application 2002/00116856 filed by Troyer on Feb. 15, 2002 and published Aug. 29, 2002 which discloses a bootlike device which clamps around the small of the gunstock, blocking access to the trigger and lever of the firearm.

However, the unit is somewhat bulky in design; would incur relatively high fabrication costs and would not allow opening of the firearm action to determine whether the firearm was loaded or whether cleaning was needed.

The document noted above also mentions a prior approach in which cable type padlocks are threaded through the action with a possibility of damage to common accessories while the rifle is being transported.

SUMMARY OF THE INVENTION

It is an object of the invention to provide a locking device for a lever action firearm which, while installed, will still enable determination of whether the firearm is loaded and whether cleaning is needed.

It is another object of the invention to provide a locking device for a lever action firearm which is relatively compact and simple to install and remove from the firearm, and yet reliable in operation.

Accordingly, the invention provides a locking device for a lever action firearm having a safety mechanism which disconnects the trigger when the lever is open to prevent discharge of the firearm comprising means for clamping releasably on one of the lever and stock an abutment which is interposed therebetween and is brought into engagement with another of the lever and stock by movement of the lever towards a closed position to maintain the lever open, spaced apart from the stock by a predetermined minimum amount, which will prevent deactivation of the safety mechanism and discharge of the firearm.

Thus, the lever remains free to move when the locking device is installed enabling inspection to determine whether the firearm is loaded and to permit cleaning. Furthermore, the firearm cannot accidentally discharge if dropped.

Preferably, the clamping means clamps the abutment on the lever.

In one embodiment, the firearm lever has a handle loop providing opposed, spaced apart rails and the clamping means comprises first and second clamping jaws having means for locating the jaws on the rails in bridging relation with the abutment extending towards the stock from an end of at least one of the clamping jaws, and complementary latching means on the jaws cooperable to fasten the jaws together by movement of the jaws together into rail clamping position.

This enables easy and accurate installation of the locking device on the lever.

Conveniently, the abutment is integrally formed with an end of said at least one of the clamping jaws as a continuation thereof, providing an extremely simple structure and minimizing the number of parts facilitating mass production at low cost.

The locating means comprises a pair of rail receiving grooves formed on at least one of the clamping jaws at a same spacing apart as a spacing apart of the rails. The clamping jaws may each comprises an elongate metal plate with the rail receiving grooves extending across a face thereof.

Preferably, the plates comprise a complementary pin and socket adjacent the grooves progressively interengagable to guide the plates together in face to face relation clamping the rails between them, further facilitating rapid installation.

In a particularly advantageous version, the complementary latching means comprises an undercut latching recess with a latching lip in one plate and a latch member in another plate, the latch member having a rear end formed with a release lug and an opposite leading end having a camming surface terminating in a rearwardly facing catch and mounted for rocking movement against a biasing spring from a latching to a release position, a lock having a second release lug aligned for engagement with the first release lug by moving the lock to an unlocking position, whereby moving the plates together will cause the leading end of the latch to engage and ride over the lip into the latching recess with a snap action to latch the plates together in lever clamping position and subsequent movement of the lock to an unlocking position will bring the second release lug into engagement with the first release lug to rock the latch member withdrawing the catch from behind the lip so that the plates can be separated to release the lever. An helical compression spring is mounted on at least one of the pins to urge the plates apart when the catch is withdrawn from behind the lip.

Thus, the locking device can be installed rapidly and locks automatically by simply squeezing the plates together about the rails.

The complementary latching means are mounted at a central location of each plate providing optimal balance.

Another abutment can be integrally formed with another, opposite end of said at least one of the clamping jaws as a continuation thereof enabling the installation in either of two positions thereof further facilitating speed of installation which encourages desirably frequent use.

BRIEF DESCRIPTION OF THE DRAWINGS

In order that the invention may be readily understood, a specific embodiment thereof will now be described by way of example only and with reference to the accompanying drawings in which.

DETAILED DESCRIPTION OF THE INVENTION

Figure 1:
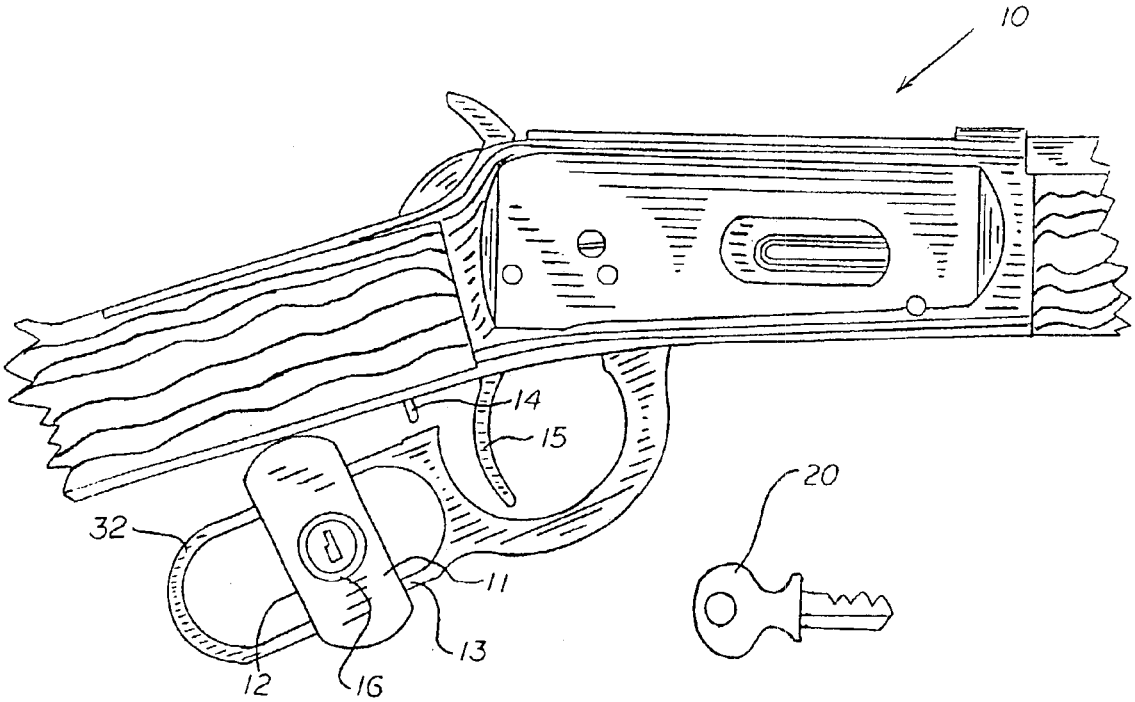
FIG. 1 is a fragmentary side elevation of a Winchester firearm with the locking device of the invention attached.
Figure 2:
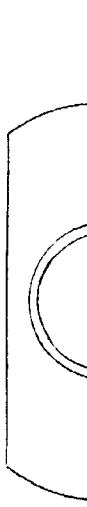
FIG. 2 is a side elevation of the locking device at an increased scale.
Figure 3:
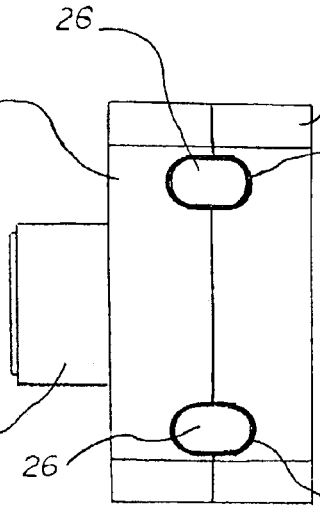
FIG. 3 is an end elevation of the locking device with clamping plates thereof closed together and locked in clamping position.
Figure 4:
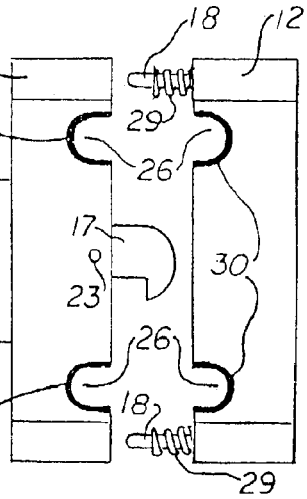
FIG. 4 is an end elevation of the locking device in open position.
Figure 5:
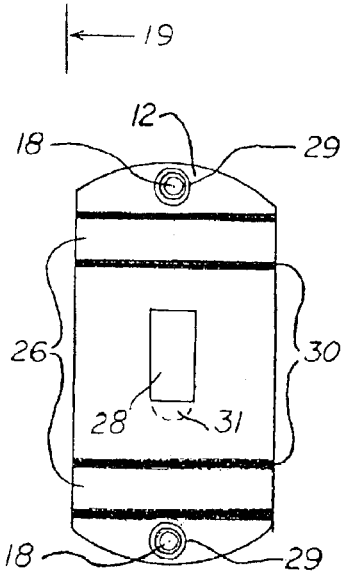
FIG. 5 is an elevational view of an inside face of one of the clamping plates of the locking device; and, FIG. 6 is a schematic partly cross-sectional view taken along lines 19—19 of FIG. 2 showing an internal latching mechanism and lock.

FIG. 1 shows the gun locking device installed on a Winchester Mod. 94 lever action carbine 10 in use today by sportsmen. The major parts of the locking device comprise elongate clamping plates 11 and 12, (plate 12 being directly behind plate 11), which are shown locked in place, clamped about the firearm's lever 13, which normally has a rotational range of 90 degrees, reduced, only marginally, by the presence of the clamping plates 11 and 12, to about 80 degrees.

All lever action firearms are equipped with some form of firing disconnect in the event of an open lever and, in the firearm named above, the disconnect is normally deactivated by the lever 13 pressing pin 14 when the lever is raised to a closed position adjacent the small of the stock. The locking device prevents the lever coming into engagement with the pin and, therefore, depression of the pin, as abutments formed by extended ends of the plates 11 and 12 are first brought into engagement with the small of the stock during movement of the lever towards a closed position. Thus, the lever cannot free up one of the weapon's primary safety features, (an internal lock on trigger 15, deactivated by depression of pin 14), so the firearm cannot be fired. The device can be quickly removed from the firearm by inserting key 20 in the lock 16 and twisting it 90 degrees.

Figure 6:
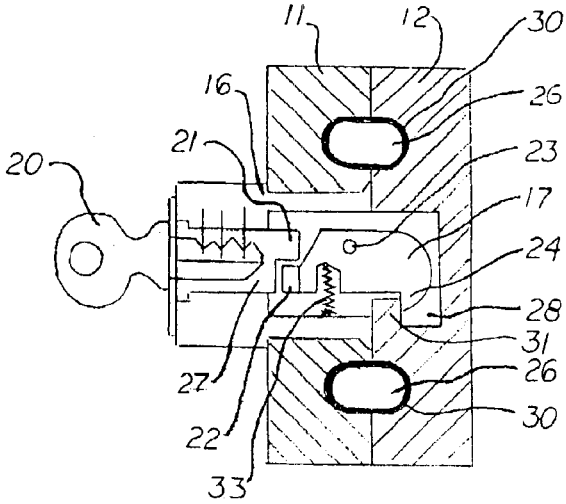

As shown in FIGS. 2–6, opposed faces of clamping plates 11 and 12 are each formed at correspondingly locations with rail receiving grooves 26, coated with a rubberized coating 30 to protect the finish of the firearm and prevent the sliding of plates 11 and 12 on rails 32, (FIG. 1). Alignment pins 18 (FIGS. 4 and 5) outstand from the face of plate 12 for receipt in aligned sockets on plate 11 in the locked condition and carry compression springs 29. As seen in FIG. 6, an undercut latching recess 28 is formed in the face of plate 12 providing a latching lip 31.

A lock 16 comprises a lock barrel 27 in a lock housing seated in a through bore formed in plate 11, and formed with an release lug 21 rotatable on turning the key 20. A latch 17 is pivotally mounted in the housing by pivot pin 23 and is formed, at a rear, with a release lug 22, engageable by release lug 21 when rotated, and at a front with a latching lug or catch 24 at the end of a cam surface at a leading end. A compression spring 33 is seated in a recess in latch 17 biasing the catch into the latching recess 28 in the locking position.

The locking device is installed by lowering the firearm lever slightly and holding plates 11 and 12 spread apart, over the center of the lever 13 (FIG. 1) with the alignment pins 18 (FIG. 4) in registration with corresponding sockets so that the rails 32 of the lever 13 are aligned between the grooves 26; and, squeezing plates 11 and 12 together, to insert alignment pins 18 (FIG. 4) further into the sockets while compressing springs 29. This actin will cause the latching lug or catch 24 to engage and override lip 31, initially compressing biasing spring 33 and, when clear of the lip, to snap into recess 28 locking plates 11 and 12 together.

When installed, raising the lever will bring the abutment formed by a continuation of one end of each of the clamping plates into abutment with the stock, maintaining the lever paced apart from the pin 14 to prevent actuation of the trigger mechanism. The plates extend at both ends for an identical distance beyond each of the grooves enabling the locking device to be installed in either of two positions.

To free the device for firing the firearm, key 20 is inserted and twisted in lock 16 bringing lug 21 of lock barrel 27 into depressing engagement with lug 22 of latch 17, rotating it counterclockwise against the action of spring 33, above the lip, so that the lug or catch 24 is raised above the lip 31 and disengaged from recess 28 thereby allowing plates 11 and 12 to be thrown apart off the rails 32 by the expanding springs 29 permitting the lever to be fully raised to depress 14 enabling firing of the firearm.

When firearms are locked with the gun lock described above, the action can still be opened to determine if gun is loaded or in need of cleaning. Installation of this lock on an inadvertently loaded gun renders the gun unfireable. If desired, a combination lock may be used instead of a key operated lock.

The plates 11 and 12 can be installed at any desired location along the opposed rails 32 of the handle of lever 13 or reversed without reducing the effectiveness of the locking device.

What is claimed is:

1. A locking device for a lever action firearm having a safety mechanism which disconnects a trigger when a lever is open to prevent discharge of the firearm comprising means for clamping releasably on the lever an abutment which is interposed between the lever and a stock of the firearm and is brought into engagement with the stock by movement of the lever towards a closed position thereby to maintain the lever open, spaced apart from the stock by a predetermined minimum amount, which will prevent deactivation of the safety mechanism and discharge of the firearm, the lever having a handle loop providing opposed, spaced apart rails and the clamping means comprises first and second clamping jaws having means for locating the jaws on the rails in bridging relation with the abutment extending towards the stock from an end of at least one of the clamping jaws.

2. A locking device according to claim 1 wherein the clamping means comprises complementary latching means on the jaws cooperable to fasten the jaws together by movement of the jaws together into rail clamping position.

3. A locking device according to claim 2 wherein the complementary latching means comprises an undercut latching recess with a latching lip in one plate and a latch member in another plate, the latch member having a rear end formed with a release lug and an opposite leading end having a camming surface terminating in a rearwardly facing catch and mounted for rocking movement against a biasing spring from a latching to a release position, a lock having a second release lug aligned for engagement with the first release lug by moving the lock to an unlocking position, whereby moving the plates together will cause the leading end of the latch to engage and ride over the lip into the latching recess with a snap action to latch the plates together in lever clamping position and subsequent movement of the lock to an unlocking position will bring the second release lug into engagement with the first release lug to rock the latch member withdrawing the catch from behind the lip so that the plates can be separated to release the lever.

4. A locking device according to claim 3 wherein an helical compression springs are mounted on at least one of the pins to urge the plates apart when the catch is withdrawn from behind the lip.

5. A locking device according to claim 3 wherein the complementary latching means are mounted at a central location of each plate.

6. A locking device according to claim 2 wherein the firearm has a depressable pin which protrudes from the small of the stock toward the lever, depression of which pin deactivates an internal lock on the trigger, and the abutment prevents depression of the pin.

7. A locking device according to claim 1 wherein the abutment is integrally formed with an end of said at least one of the clamping jaws as a continuation thereof.

8. A locking device according to claim 7 wherein another abutment is integrally formed with another, opposite end of said at least one of the clamping jaws as a continuation thereof.

9. A locking device according to claim 1 wherein the locating means comprises a pair of rail receiving grooves formed on at least one of the clamping laws at a same spacing apart as a spacing apart of the rails.

10. A locking device according to claim 9 wherein the clamping jaws each comprises an elongate metal plate with the rail receiving grooves extending across a face thereof.

11. A locking device according to claim 10 wherein the plates comprise a complementary pin and socket adjacent the grooves progressively interengagable to guide the plates together in face to face relation clamping the rails between them.

* * * * *